US007014381B1

(12) United States Patent
Graham

(10) Patent No.: US 7,014,381 B1
(45) Date of Patent: Mar. 21, 2006

(54) SOAP HOLDING DEVICE

(76) Inventor: Dwight H. Graham, 1717 Browning Blvd., Los Angeles, CA (US) 90062

( * ) Notice: Subject to any disclaimer, the term of this patent is extended or adjusted under 35 U.S.C. 154(b) by 110 days.

(21) Appl. No.: 10/693,702

(22) Filed: Oct. 24, 2003

(51) Int. Cl.
*A47K 7/01* (2006.01)
*B43K 8/10* (2006.01)

(52) U.S. Cl. ..... 401/201

(58) Field of Classification Search ..... 401/196, 401/201; 383/117; 206/77.1; D6/608
See application file for complete search history.

(56) References Cited

U.S. PATENT DOCUMENTS 1,577,861 A * 3/1926 Henry ..... 401/201
2,210,754 A * 8/1940 Frank ..... 401/201
2,668,309 A * 2/1954 Colgan ..... 401/201
2,899,780 A * 8/1959 Bottino ..... 401/201
3,368,233 A * 2/1968 Lemberger ..... 401/196
3,426,464 A * 2/1969 Livia ..... 401/201
3,431,055 A * 3/1969 Lowery ..... 401/201
3,488,126 A * 1/1970 Avallone ..... 401/201
4,159,883 A * 7/1979 Mizell ..... 401/201
4,196,534 A 4/1980 Shibamoto
4,659,495 A 4/1987 Figliola
4,674,237 A * 6/1987 Sullivan ..... 401/201
4,733,426 A 3/1988 George
5,031,759 A 7/1991 Ogilvie
5,366,125 A 11/1994 Procido
D360,797 S 8/1995 Evans
5,609,255 A * 3/1997 Nichols ..... 206/576

* cited by examiner

*Primary Examiner*—Tuan Nguyen

(57) ABSTRACT

A soap holding device for holding soap while bathing and showering. The device includes a flexible bag for holding soap therein having an opening therein and a plurality of apertures therethrough. A flexible strap for looping around the wrist of a user is coupled to the bag. A flexible outer sponge with an opening therein into which the bag is inserted such that the outer sponge generally envelops the bag.

2 Claims, 5 Drawing Sheets

SOAP HOLDING DEVICE

BACKGROUND OF THE INVENTION

1. Field of the Invention

The present invention relates to soap holding devices and more particularly pertains to a new soap holding device for holding soap while bathing and showering.

2. Description of the Prior Art

The use of soap holding devices is known in the prior art. More specifically, soap holding devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,031,759; U.S. Pat. No. 4,733,426; U.S. Pat. No. 5,366,125; U.S. Pat. No. 4,196,534; U.S. Pat. No. 4,659,495; and U.S. Pat. No. Des. 360,797.

While these devices fulfill their respective, particular objectives and requirements, the aforementioned patents do not disclose a new soap holding device. The inventive device includes a flexible bag for holding soap therein having an opening therein and a plurality of apertures therethrough. A flexible strap for looping around the wrist of a user is coupled to the bag. A flexible outer sponge with an opening therein into which the bag is inserted such that the outer sponge generally envelopes the bag.

In these respects, the soap holding device according to the present invention substantially departs from the conventional concepts and designs of the prior art, and in so doing provides an apparatus primarily developed for the purpose of holding soap while bathing and showering.

SUMMARY OF THE INVENTION

In view of the foregoing disadvantages inherent in the known types of soap holding devices now present in the prior art, the present invention provides a new soap holding device construction wherein the same can be utilized for holding soap while bathing and showering.

The general purpose of the present invention, which will be described subsequently in greater detail, is to provide a new soap holding device apparatus and method which has many of the advantages of the soap holding devices mentioned heretofore and many novel features that result in a new soap holding device which is not anticipated, rendered obvious, suggested, or even implied by any of the prior art soap holding devices, either alone or in any combination thereof.

To attain this, the present invention generally comprises a flexible bag for holding soap therein having an opening therein and a plurality of apertures therethrough. A flexible strap for looping around the wrist of a user is coupled to the bag. A flexible outer sponge with an opening therein into which the bag is inserted such that the outer sponge generally envelops the bag.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new soap holding device apparatus and method which has many of the advantages of the soap holding devices mentioned heretofore and many novel features that result in a new soap holding device which is not anticipated, rendered obvious, suggested, or even implied by any of the prior art soap holding devices, either alone or in any combination thereof.

It is another object of the present invention to provide a new soap holding device which may be easily and efficiently manufactured and marketed.

It is a further object of the present invention to provide a new soap holding device which is of a durable and reliable construction.

An even further object of the present invention is to provide a new soap holding device which is susceptible of a low cost of manufacture with regard to both materials and labor, and which accordingly is then susceptible of low prices of sale to the consuming public, thereby making such soap holding device economically available to the buying public.

Still yet another object of the present invention is to provide a new soap holding device which provides in the apparatuses and methods of the prior art some of the advantages thereof, while simultaneously overcoming some of the disadvantages normally associated therewith.

Still another object of the present invention is to provide a new soap holding device for holding soap while bathing and showering.

Yet another object of the present invention is to provide a new soap holding device which includes a flexible bag for holding soap therein having an opening therein and a plurality of apertures therethrough. A flexible strap for looping around the wrist of a user is coupled to the bag. A flexible outer sponge with an opening therein into which the bag is inserted such that the outer sponge generally envelops the bag.

Still yet another object of the present invention is to provide a new soap holding device that can hold a bar of soap or pieces of soap that can be looped on to the wrist of a user so that the user can easily locate and use the soap when washing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
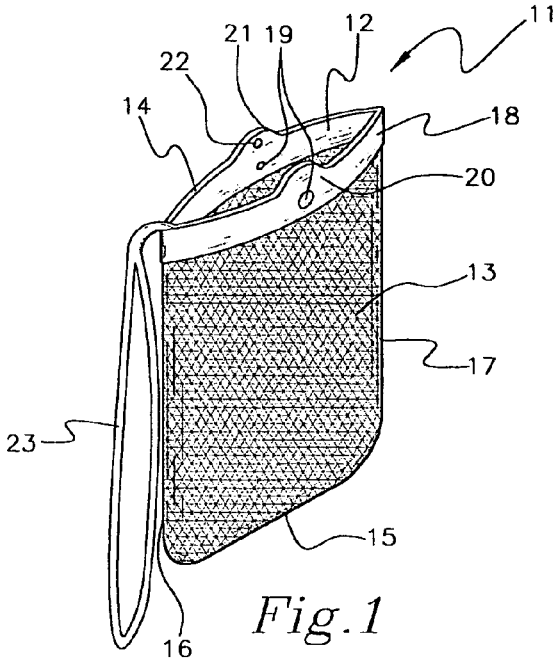
FIG. 1 is a schematic perspective view of a bag of a new soap holding device according to the present invention.
Figure 2:
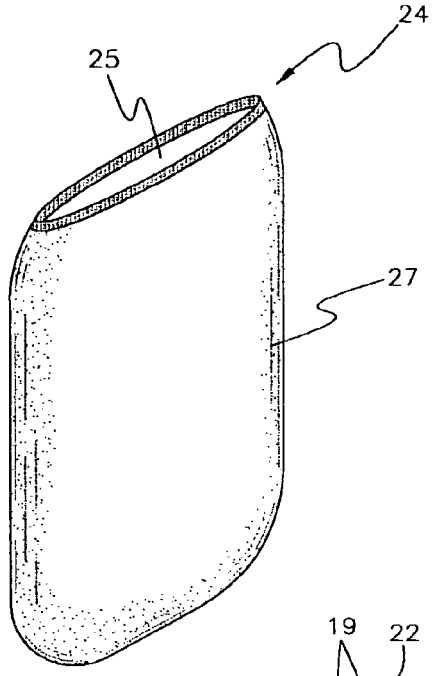
FIG. 2 is a schematic perspective view of the outer sponge of the present invention.
Figure 3:
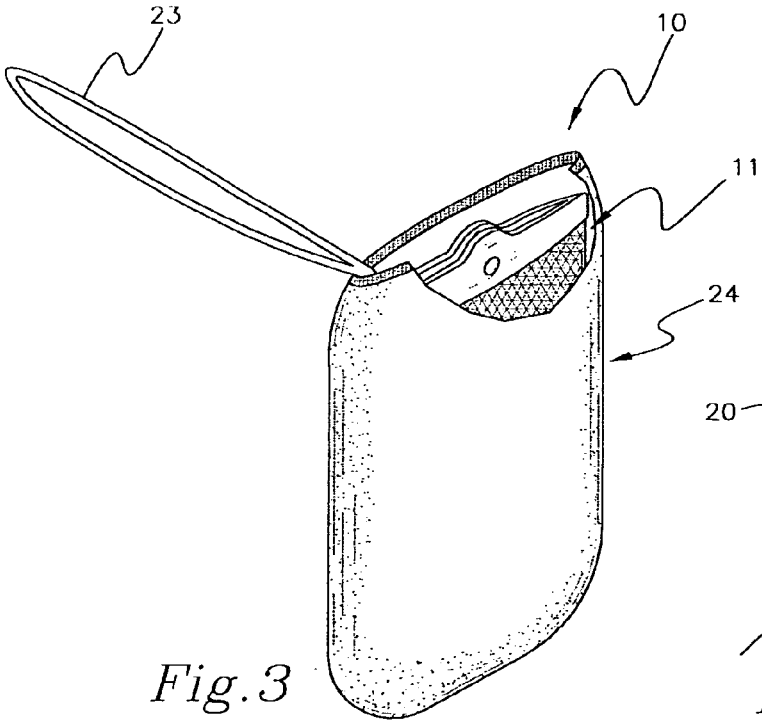
FIG. 3 is a schematic perspective breakaway view of the present invention.
Figure 4:
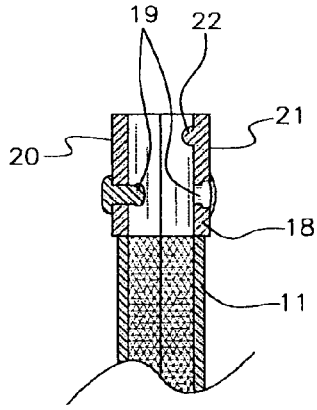
FIG. 4 is a schematic cross sectional view of the tabs of the bag pulled apart so that the opening of the bag is open.
Figure 5:
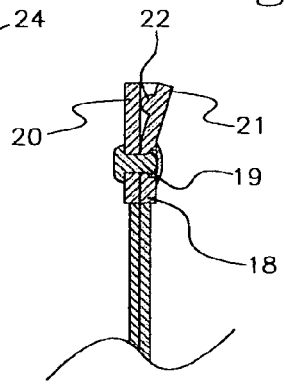
FIG. 5 is a schematic cross sectional view of the present invention with the fastener closing the opening of the bag.

With reference now to the drawings, and in particular to FIGS. 1 through 15 thereof, a new soap holding device embodying the principles and concepts of the present invention and generally designated by the reference numeral 10 will be described.

As best illustrated in FIGS. 1 through 15, the soap holding device 10 generally comprises a flexible bag 11 for holding soap therein having an opening 12 therein and a plurality of apertures 13 therethrough. A flexible strap 23 for looping around the wrist of a user is coupled to the bag 11. A flexible outer sponge 24 with an opening 25 therein into which the bag 11 is inserted such that the outer sponge 24 generally envelops the bag 11.

In closer detail, the soap holding device 10 includes a flexible bag 11 for holding soap therein including a bar of soap or small pieces of soap from a used bar of soap. The bag 11 has an opening 12 therein, and a plurality of apertures 13 therethrough for permitting passage of water and soap suds between the exterior and the interior of the bag 11. Preferably, the bag 11 comprises a flexible net fabric although it may also be made from a loose knit or loosely woven fabric or a mesh fabric. The bag 11 preferably has a generally rectangular configuration with a pair of opposite ends 14,15 and a pair of sides 16,17 extending between the ends of the bag 11. Ideally, the bag 11 has a length defined between the ends of the bag 11 between about 4 inches and about 6 inches and a width defined between the sides of the bag 11 between about 3 inches and about 5 inches, the opening 12 of the bag 11 is located at one end of the bag 11. A flexible looped strap 23 for looping around the wrist of a user is coupled to the bag 11 adjacent the outer perimeter of the opening 12 of the bag 11. Alternately, the looped strap 23 and bag 11 may be integrally formed as a single unit.

The bag 11 has a reinforced portion 18 around the outer perimeter of the opening 12 of the bag 11. In an ideal illustrative embodiment, the reinforced portion has a width defined parallel to the ends of the bag 11 of about ±2 inch. The bag 11 has at least one fastener 19 located on the reinforced portion adjacent the outer perimeter of the opening 12 of the bag 11 for closing the opening 12. Ideally, the fastener 19 comprises at least one snap fastener. In a preferred embodiment, the reinforced portion 18 of the bag 11 has a pair of opposing tabs 20,21. Preferably, the tabs 20,21 are positioned adjacent the snap fastener 19. In the ideal illustrative embodiment, the tabs 20,21 extend about ¼ inch from the edge of the reinforce portion. In use, the tabs 20,21 of the reinforced portion 18 are positioned adjacent one another when the fastener 19 closes the opening 12 of the bag 11. One of the tabs 21 of the reinforced portion has a nub 22 extending towards the other tab for spacing the tabs 20,21 slightly apart when the opening is closed for aiding the pulling apart of the complementary portions of the fastener 19. The reinforced portion 18 is preferably glued to an interior of the sponge to hold the bag in place within the sponge. Further, the sponge is hollowed out to accommodate a full bar of soap within the sponge.

Figure 6:
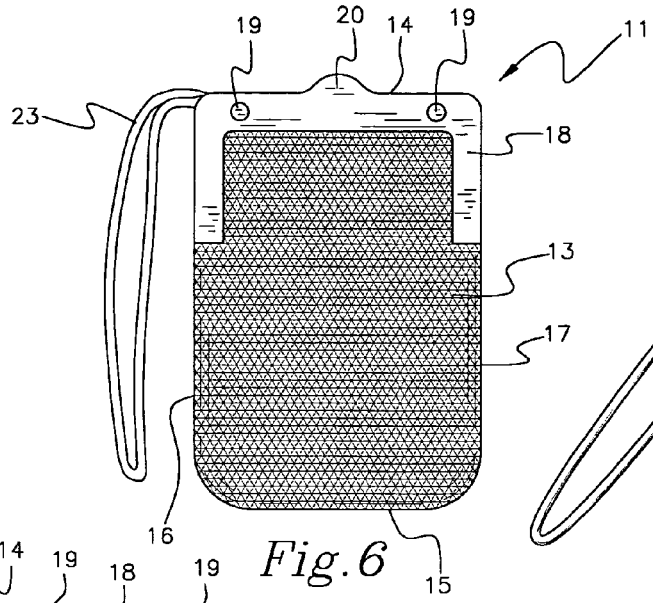
FIG. 6 is a schematic side view of a preferred optional embodiment of the bag of the present invention.
Figure 7:
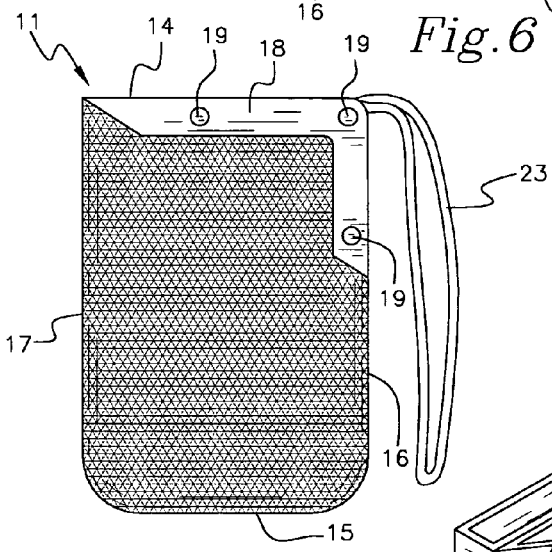
FIG. 7 is a schematic side view of a preferred optional embodiment of the bag of the present invention.
Figure 8:
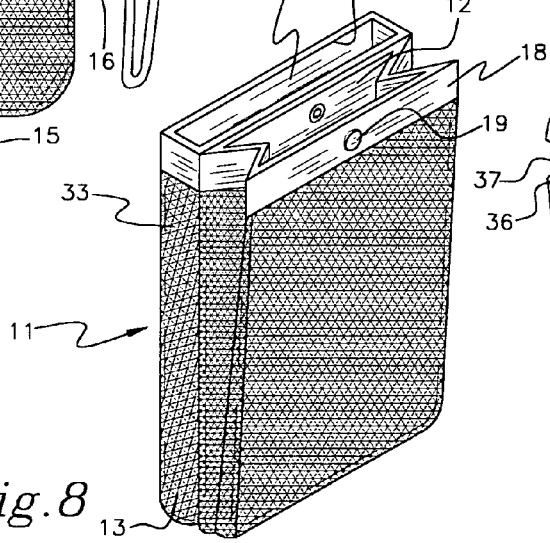
FIG. 8 is a schematic side view of a preferred optional embodiment of the bag view of the present invention with a secondary compartment.
Figure 9:
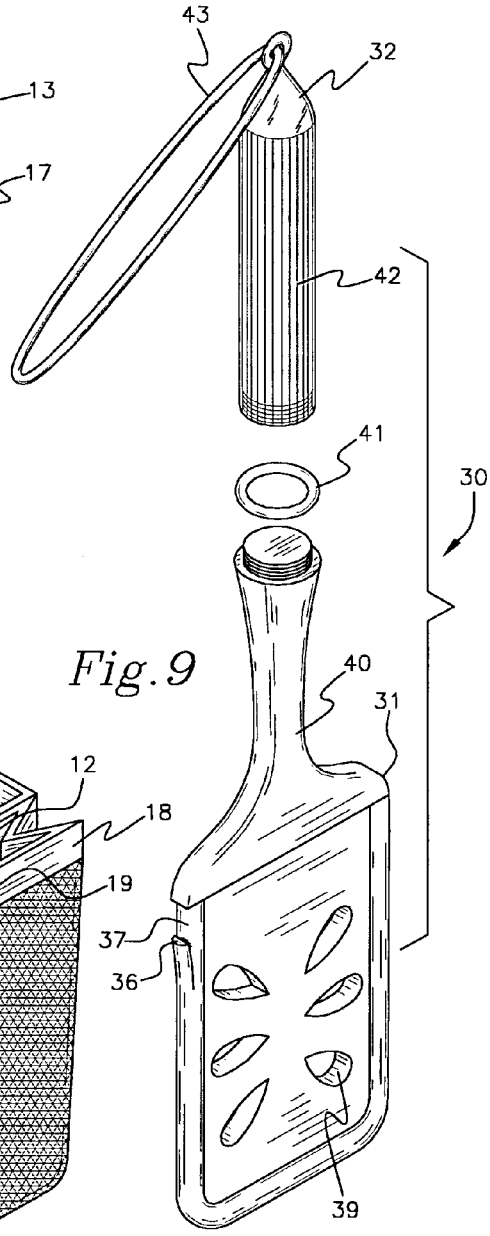
FIG. 9 is a schematic exploded perspective view of the paddle of the present invention.
Figure 10:
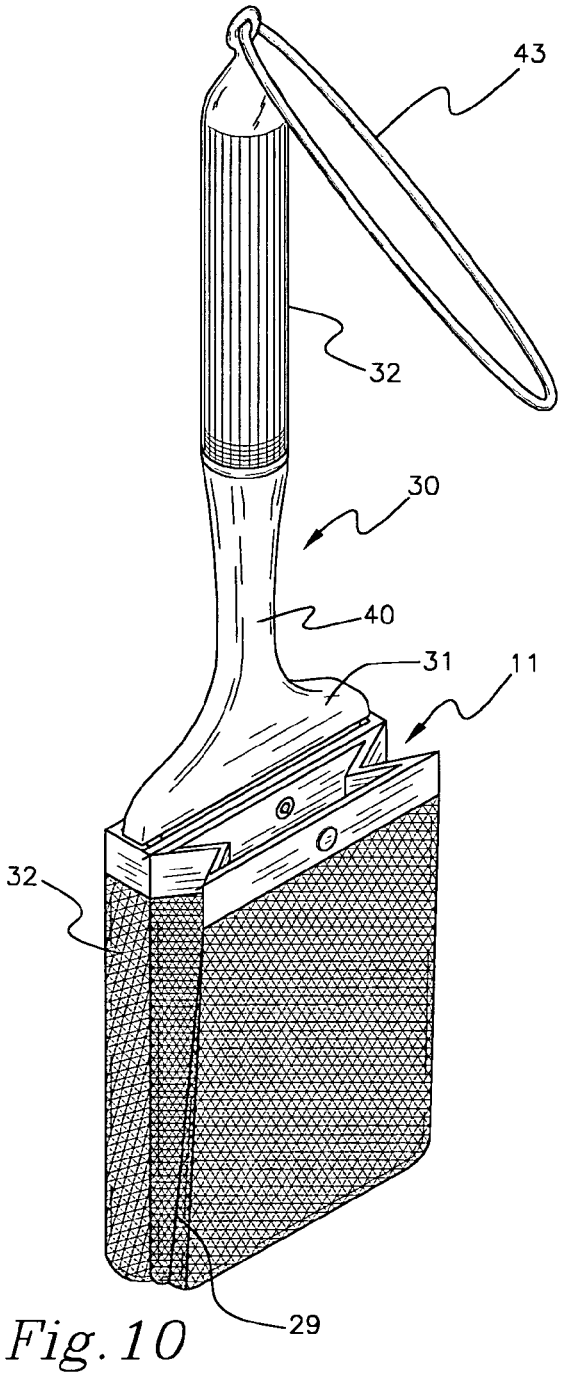
FIG. 10 is a schematic perspective view of the paddle of the present invention inserted into the embodiment of the bag illustrated in FIG. 8.

With reference to FIGS. 6, 7, and 8, the opening 12 of the bag may be configured in a number of different optional configurations than the configuration illustrated in FIG. 1 where the opening 12 extends on the end 14 between the sides 16,17 of the bag 11. In a first configuration as illustrated in FIG. 7, the outer perimeter of the opening 12 of the bag 11 extends across the one end of the bag 11 and a portion of one of the sides of the bag 11 such that the reinforced portion has a pair of L-shaped regions. In a second configuration as shown in FIG. 6, the outer perimeter of the opening 12 of the bag 11 extends across the one end of the bag 11 and a portion of each of the sides of the bag 11 such that the reinforced portion has a pair of U-shaped regions. In an ideal third configuration as illustrated in FIG. 8, the sides of the bag 11 are pleated such that the reinforced portion has a pair pleated regions 29. The reinforced portion is correspondingly shaped to match the configurations as shown in FIGS. 6, 7, 8 and 12.

Figure 13:
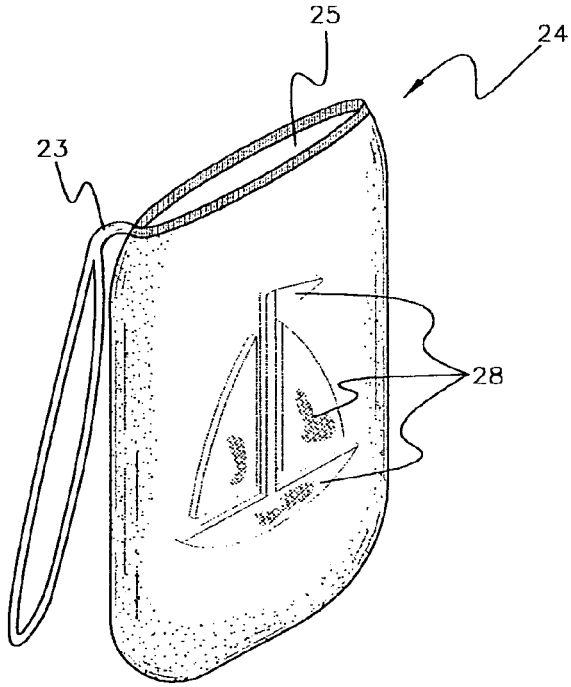
FIG. 13 is a schematic perspective view of an ideal embodiment of the outer sponge of the present invention with raised portions.
Figure 15:
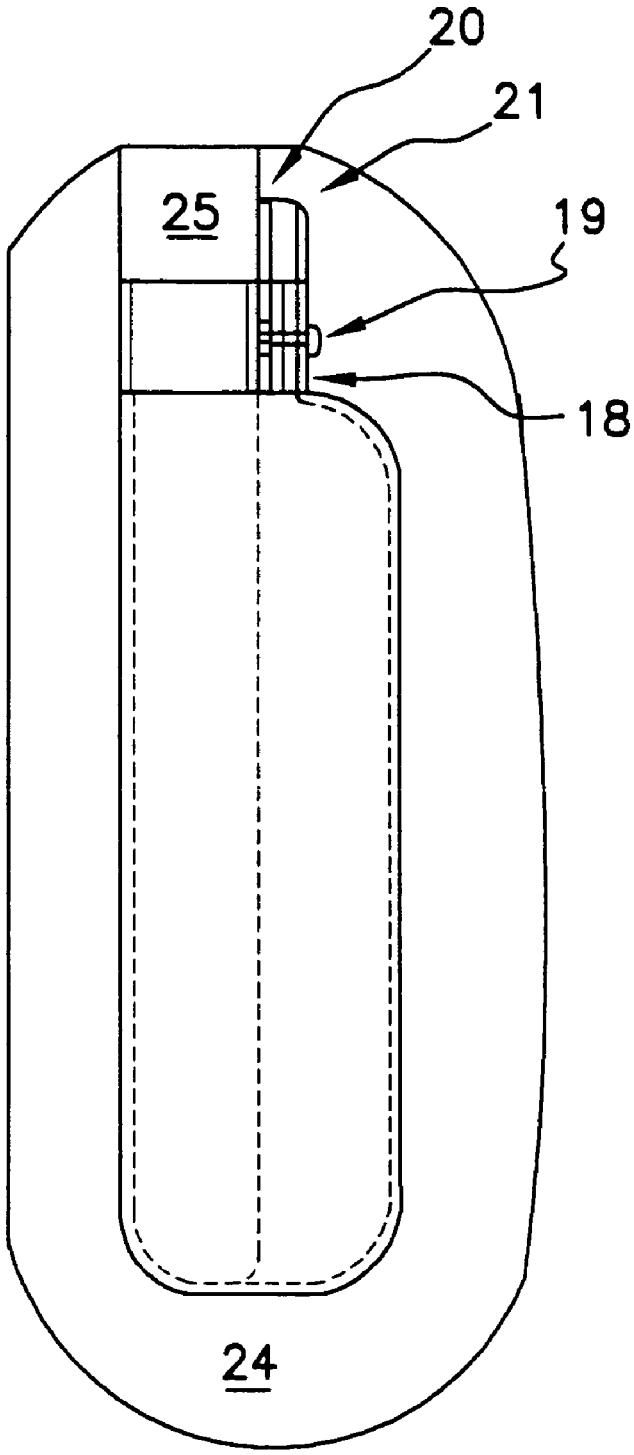
FIG. 15 is a schematic cross-sectional view of an embodiment of the outer sponge and bag portions of the present invention for use in conjunction with the paddle of the present invention.

A flexible outer sponge 24 has an opening 25 therein. The bag 11 is removably inserted into the opening 25 of the outer sponge 24 such that the outer sponge 24 substantially encloses envelops the bag 11 while leaving the strap 23 exposed. The outer sponge 24 preferably comprises a sponge material adapted for saturating with water and soap suds from the soap in the bag 11. In a preferred embodiment, the exterior surface 27 of the outer sponge 24 has raised portions 28 outwardly extending therefrom. The raised portions 28 preferably comprise a resiliently deformable material such as a soft rubber for providing a slight roughness for washing. The raised portions 28 ideally extend about ⅛ inch out from the exterior surface 27 of the outer sponge 24. Ideally, as illustrated in FIG. 13, the raised portions 28 are configured to resemble an image or a design such as a logo or a crest.

A paddle 30 is preferably provided having a head 31 and a handle 32 so that the soap holding device may be used on the back and other hard to reach areas on the user. Preferably the paddle 30 has rounded edges so that the paddle 30 has no exposed sharp edges. When a paddle is provided, it is preferred that the bag 11 have a secondary compartment 33 with an opening 34 therein and a plurality of apertures 13 therethrough and comprising a net fabric material like the rest of the bag 11. The opening 34 of the secondary compartment 33 also has a reinforced region 35 extending therearound. The head 31 of the paddle 30 is inserted into the secondary compartment 33 through the opening of the secondary compartment 33 such that the handle 32 outwardly extends from the opening of the secondary compartment 33. The head 31 of the paddle 30 has a plurality of holes therethrough which are each preferably generally tear-shaped and designed for permitting the passage of soap and water through the head 31 of the paddle 30 when the paddle is in the bag 11. The head 31 of the paddle 30 preferably has a generally rectangular configuration has a pair of ends and a pair of sides extending between the ends of the head. Each of the sides of the head 31 has a protrusion 36 for helping hold the head 31 in the secondary compartment 33. The sides of the head each also preferably have a notch 37 therein for receiving portions of the reinforced region of the secondary compartment 33. Ideally, the head 31 has a rounded outer peripheral region extending around the sides and one end of the head.

The head 31 of the paddle 30 has a stem portion 40 connecting the handle 32 to the head 31. The handle 32 preferably has a hollow interior for holding items therein such as a wash cloth. The handle 32 is threadably attached to the stem portion 40 to permit detachment of the handle 32 to provide an opening into the hollow interior of the handle 32. Ideally, a washer 41 is provided to help form a watertight seal between the handle 32 and the stem portion 40. Ideally, the handle 32 comprises a generally transparent or translucent material to permit viewing of the interior of the handle 32. Ideally, the handle 32 has exterior gripping ridges 42 extending along the length of the handle 32 for aiding the grip of the user holding the handle 32 while wet and slippery. The handle 32 of the paddle 30 also preferably includes a flexible looped strap 43 coupled thereto distal the head 31 of the paddle 30. In use, the strap 43 of the handle 32 is designed for looping around the wrist of the user.

Figure 11:
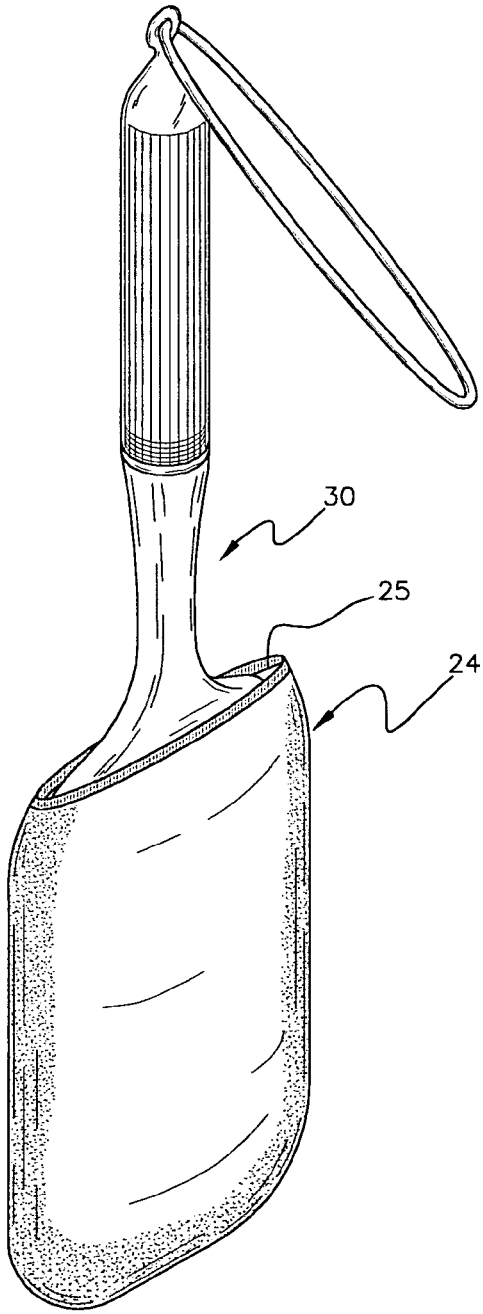
FIG. 11 is a schematic perspective view of the present invention with a paddle.
Figure 12:
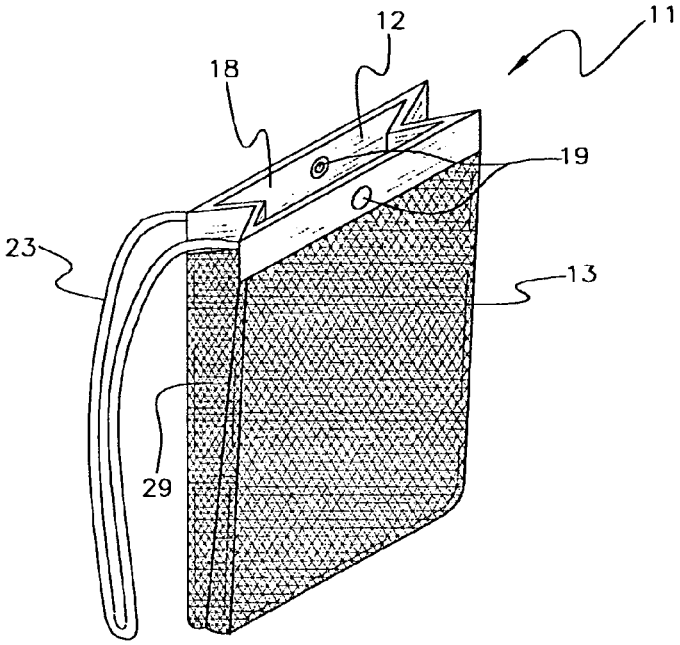
FIG. 12 is a schematic side view of another preferred optional embodiment of the bag of the present invention.

As shown in FIG. 11, the bag 11 is covered by outer sponge 24. The reinforced portion 18 of the bag 11 is preferably glued to the interior of the outer sponge such that the outer sponge and bag act as a single replaceable unit attachable to the paddle 30.

Figure 14:
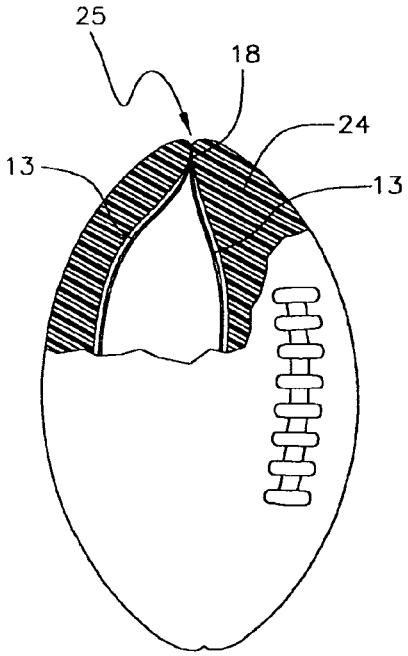
FIG. 14 is a schematic partial cut-away view of an embodiment of the present invention.

FIG. 14 shows an embodiment of the present invention employing a decorative shape for the sponge 24 and a partial cut-away to show the hollowing of the interior of the sponge 24 to accommodate a full size bar of soap within the bag 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A soap holding device, comprising:

a flexible bag for holding soap therein, said bag having an opening therein, and a plurality of apertures therethrough, said opening of said bag has an outer perimeter, said bag having a reinforced portion around said outer perimeter of said opening of said bag;

a flexible outer sponge having an opening therein, said bag being inserted into said opening of said outer sponge such that said outer sponge generally envelops said bag, said flexible outer sponge having a convex interior wall for accommodating at least one bar of soap;

a closure means operationally coupled to said reinforced portion for selectively maintaining said opening in a closed position inhibiting access to an interior of said bag;

a paddle member having a head portion and a handle portion, said head portion being selectively positionable in said bag, said handle portion being adapted for being grasped by a hand of a user;

said bag having a second compartment, said secondary compartment having an opening therein, said head portion of said paddle being inserted into said second compartment through said opening of said secondary compartment;

wherein said handle portion further comprises a stem portion coupled to said head portion and a handle removably coupled to said stem portion;

wherein said handle is substantially hollow for selectively receiving a user accessory;

wherein said handle is transparent for facilitating visual observation of the user accessory received in said handle;

said stem portion having a first set of threads applied thereon;

said handle having a second set of threads complementary to said first set of threads applied thereon, said first set of threads and said second set of threads facilitating coupling of said stem portion of said handle portion to said handle of said handle portion;

an o-ring member positionable between said stem portion and said handle;

wherein said head portion having a plurality of holes therethrough, said holes of said head portion of said paddle being generally tear-shaped;

a lanyard loop operationally coupled to said handle portion; and a strap member couplable to said lanyard loop for selectively securing said device to a wrist of a user.

2. The soap holding device of claim 1 further comprising:

said bag has a first opening for selectively receiving at least one bar of soap and a second opening for receiving said paddle member, said first opening of said bag has a first outer perimeter and a first reinforced portion around said first outer perimeter of said first opening of said bag, said second opening of said bag has a second perimeter and a second reinforced portion around said second outer perimeter of said second opening of said bag; and said head portion having at least one flexible tab member for selectively engaging a bottom surface of said second reinforced portion for securing said head portion to said bag.

* * * * *